US008181575B2

(12) United States Patent
Richards

(10) Patent No.: US 8,181,575 B2
(45) Date of Patent: May 22, 2012

(54) METHOD OF VARIABLE CUTOFF PRINTING IN A PRESS HAVING A COMMON BLANKET CYLINDER

(75) Inventor: John Sheridan Richards, Barrington, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/136,154

(22) Filed: Jul. 25, 2011

(65) Prior Publication Data

US 2011/0283909 A1 Nov. 24, 2011

Related U.S. Application Data

(62) Division of application No. 12/290,940, filed on Nov. 5, 2008, now Pat. No. 8,056,475.

(51) Int. Cl.
*B41F 5/16* (2006.01)
*B41F 13/44* (2006.01)

(52) U.S. Cl. ..... 101/492; 101/177; 101/181; 101/219

(58) Field of Classification Search ..... 101/485, 101/486, 177–185, 217–221, 492, 493
See application file for complete search history.

(56) References Cited

U.S. PATENT DOCUMENTS

| | | | |
|---|---|---|---|
| 5,353,703 | A | 10/1994 | Rieker |
| 5,904,093 | A | 5/1999 | Pollock |
| 5,950,536 | A | 9/1999 | Erbstein |
| 6,327,975 | B1 | 12/2001 | Izawa |
| 7,066,088 | B2 | 6/2006 | McLean et al. |
| 7,373,880 | B2 | 5/2008 | Niemiro |
| 2002/0178945 | A1 | 12/2002 | Richards |

FOREIGN PATENT DOCUMENTS

| | | |
|---|---|---|
| DE | 41 04 209 A1 | 8/1992 |
| FR | 980.734 | 5/1951 |

*Primary Examiner* — Leslie J Evanisko
(74) *Attorney, Agent, or Firm* — Davidson, Davidson & Kappel, LLC

(57) ABSTRACT

A variable cutoff web printing press is provided including a first plate cylinder for printing a first color of first and second images and a second plate cylinder for printing a second color of the first and the second images. The printing press also includes a common blanket cylinder. The first and second plate cylinders contact the common blanket cylinder and transfer the first and second images to the common blanket cylinder. The printing press also includes a first transfer body for receiving the first image from the common blanket cylinder and transferring the first image to a web and a second transfer body for receiving the second image from the common blanket cylinder and transferring the second image to the web. A method of variable cutoff web printing is also provided.

4 Claims, 5 Drawing Sheets

METHOD OF VARIABLE CUTOFF PRINTING IN A PRESS HAVING A COMMON BLANKET CYLINDER

This application is a divisional of U.S. patent application Ser. No. 12/290,940, filed Nov. 5, 2008, now U.S. Pat. No. 8,056,475, patented Nov. 15, 2011, the entire disclosure of which is hereby incorporated by reference herein.

BACKGROUND OF INVENTION

The present invention relates generally to a printing press and more specifically to a variable cut off printing apparatus and method.

U.S. Pat. No. 5,950,536 discloses a variable cutoff offset press unit wherein a fixed cutoff press is adapted to a variable cutoff press while maintaining the size of the blanket cylinders. A plate cylinder sleeve has a variable outer diameter, whereby a length of an image to be printed is varied proportionally to a variable outer diameter while maintaining an outer diameter of the gapless blanket cylinder sleeve constant. The size of a plate cylinder is changed by using a sleeve mounted over the plate cylinder or adding packing under a plate to increase the diameter of the plate cylinder.

U.S. Pat. No. 6,327,975 discloses a method and apparatus for printing elongate images on a web. A first printing unit prints a first image portion on the web at prescribed spacings, by moving the impression cylinder away from the blanket cylinder each time one first image portion is printed. A second printing unit prints a second image portion on the spacings left on the web by the first printing unit, also by moving the impression cylinder away from the blanket cylinder each time one second image portion is printed. A variable speed motor rotates each blanket cylinder, while each time the associated impression cylinder is held away to create a space on the web for causing printing of the first or the second printing portion at required spacings.

U.S. Pat. No. 7,066,088 discloses a variable cut-off offset press system and method of operation which utilizes a continuous image transfer belt. The offset printing system comprises at least two plate cylinders adapted to have thereon respective printing sleeves. Each of the printing sleeves is adapted to receive colored ink from a respective ink source. The system further comprises at least a impression cylinder, wherein the image transfer belt is positioned to contact each of the printing sleeves at respective nips formed between respective ones of the plate cylinders and the at least one impression cylinder.

BRIEF SUMMARY OF THE INVENTION

A variable cutoff web printing press is provided including a first plate cylinder for printing a first color of first and second images and a second plate cylinder for printing a second color of the first and the second images. The printing press also includes a common blanket cylinder. The first and second plate cylinders contact the common blanket cylinder and transfer the first and second images to the common blanket cylinder. The printing press also includes a first transfer body for receiving the first image from the common blanket cylinder and transferring the first image to a web and a second transfer body for receiving the second image from the common blanket cylinder and transferring the second image to the web.

A method of variable cutoff web printing is also provided. The steps include transferring a first first image and a second first image to a common blanket cylinder, transferring the first first image from the common blanket cylinder to a first circumferential section movable with respect to a second circumferential section having a same rotational axis as the first circumferential section, printing the first first image on a web using the first circumferential section, transferring the second first image from the common blanket cylinder to the second circumferential section, and printing the second first image on the web using the second circumferential section.

BRIEF DESCRIPTION OF THE DRAWINGS

The present invention is described below by reference to the following drawings, in which.

DETAILED DESCRIPTION

Variable cutoff printing presses have been developed to allow for printing products of different sizes on the same printing press without having to change plate and blanket cylinders. Changing plate and blanket cylinders to correspond to the cutoff of the image that needs to be printed can be a time consuming and difficult process. It also may require purchasing and storing cylinders of multiple sizes.

Figure 1:
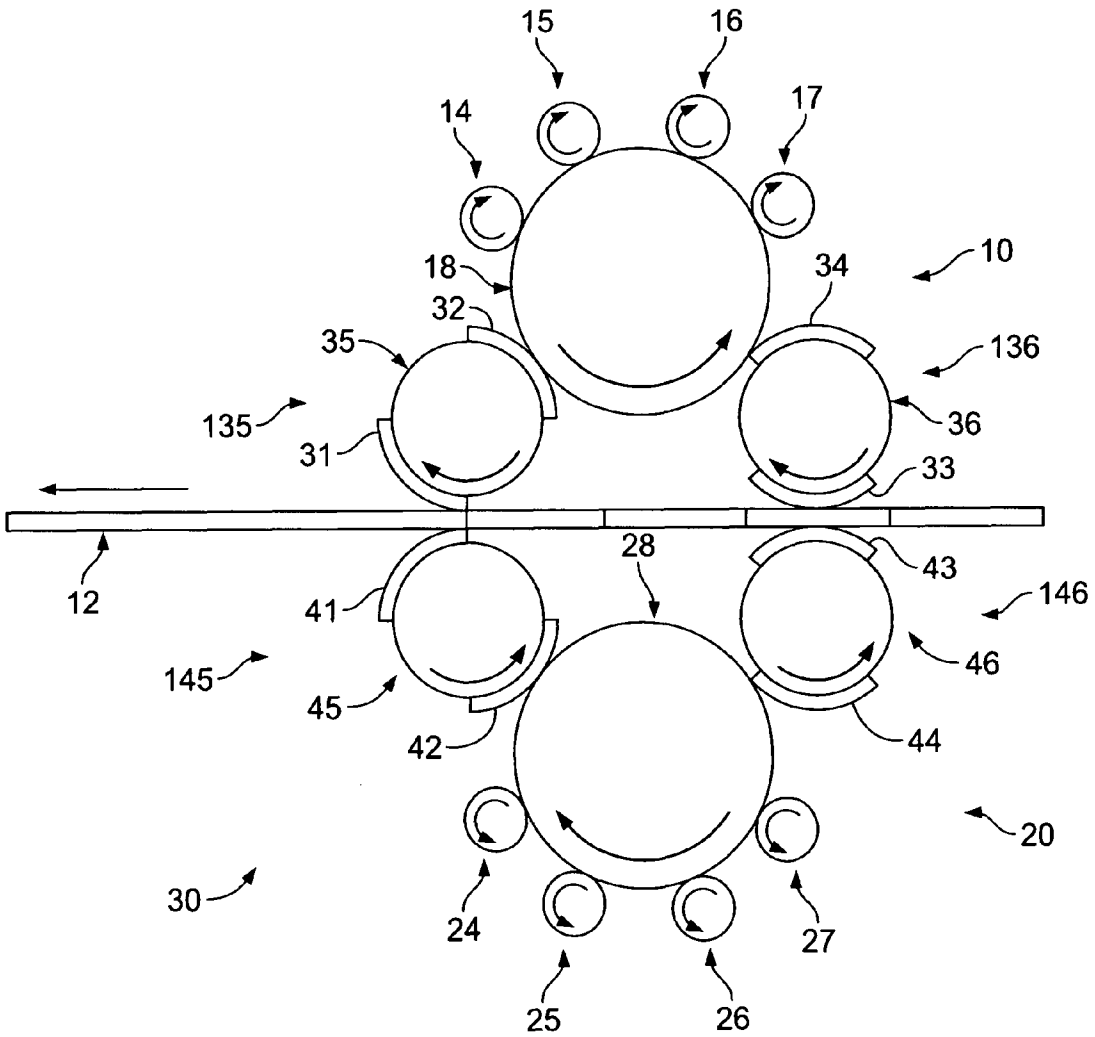
FIG. 1 shows a schematic side view of a perfecting printing press according to an embodiment of the present invention.

FIG. 1 shows a schematic side view of a perfecting printing press 30 according to an embodiment of the present invention. Printing press 30 includes two print units 10 and 20 printing on opposite sides of a passing web 12. Print unit 10 includes plate cylinders 14, 15, 16, 17, transfer bodies 135, 136 and common blanket cylinder 18. Transfer bodies 135, 136 include circumferential sections 31, 32, 33, 34 and support cylinders 35, 36, respectively. In a preferred embodiment plate cylinders 14, 15, 16, 17 may include two printing plates disposed about the surface of each plate cylinder 14, 15, 16, 17. Each plate cylinder 14, 15, 16, 17 is inked with a different colored ink and each plate cylinder 14, 15, 16, 17 rotates clockwise about a respective axis during a printing mode. The ink colors may be black, cyan, yellow and magenta, respectively, for example. Inked images are passed from each plate cylinder 14, 15, 16, 17 to common blanket cylinder 18, which then passes the images to circumferential blanket sections 31, 32, 33, 34, respectively. In turn, circumferential blanket sections 31, 32, 33, 34, which are rotating clockwise about respective support cylinders 35, 36 during the printing mode, print the images on the web. The images need to be reverse images so that the double transfer of images, first through common blanket cylinder 18, then through the respective circumferential blanket sections 31, 32, 33, 34, will be right-reading.

During the printing mode, plate cylinders 14, 15, 16, 17 act together to print a first four color image on common blanket cylinder 18. Each plate cylinder 14, 15, 16, 17 is phased to print an inked image of one color so that the four different colored images printed respectively by plate cylinders 14, 15, 16, 17 are aligned to form a first four color image on common blanket cylinder 18. Plate cylinder 17 rotates and a first plate on plate cylinder 17 prints an inked image of a first color on rotating common blanket cylinder 18. When the inked image of the first color approaches a nip formed between plate cylinder 16 and common blanket cylinder 18, a first plate on plate cylinder 16 prints an inked image of a second color on rotating common blanket cylinder 18, directly overprinting the inked image printed by the first plate of plate cylinder 17. When the overprinted inked images printed by respective first plates on cylinders 16, 17 approach a nip formed between plate cylinder 15 and common blanket cylinder 18, a first plate on plate cylinder 15 prints an inked image of a third color on rotating common blanket cylinder 18, directly overprinting the respective first images printed by respective first plates on plate cylinders 16, 17. When the overprinted inked images printed by respective first plates on plate cylinders 15, 16, 17 approach a nip formed between plate cylinder 14 and common blanket cylinder 18, a first plate on plate cylinder 14 prints an inked image of a fourth color on common blanket cylinder 18, at a position on common blanket cylinder 18 so that the image printed by the first plate on plate cylinder 14 overprints the respective images printed by the first plates on plate cylinders 15, 16, 17. Thus, the first plate on plate cylinder 14 completes a first four color image on common blanket cylinder 18.

Common blanket cylinder 18 transfers the first four color image printed by plate cylinders 14, 15, 16, 17 to one of circumferential sections 31, 32, depending on the phasing of circumferential sections 31, 32. Whichever circumferential section 31, 32 receives the first four color image printed by plate cylinders 14, 15, 16, 17 from common blanket cylinder 18 then prints the first four color image on web 12. Plate cylinders 14, 15, 16, 17, during operation, should be in constant contact with common blanket cylinder 18. In a preferred embodiment, the surfaces of plate cylinders 14, 15, 16, 17 and common blanket cylinder 18 are traveling at a substantially equal constant velocity. Common blanket cylinder 18 may have a circumference that is an integer multiple of a sum of the circumferences of plate cylinders 14, 15, 16, 17.

After plate cylinders 14, 15, 16, 17 print a first four color image on common blanket cylinder 18, respective second plates on plate cylinders 14, 15, 16, 17 print a second four color image on common blanket cylinder 18. The second four color image should be printed similar to the first four color image, with second plates on plate cylinders 14, 15, 16, 17 overprinting in a manner similar to how first plates of plate cylinders 14, 15, 15, 17 printed the first four color image.

The second four color image printed by plate cylinders 14, 15, 16, 17 is then transferred from common blanket cylinder 18 to either circumferential section 33, 34, depending on the phasing of circumferential sections 33, 34, which rotate clockwise about support cylinder 36 during operation. Whichever circumferential section 33, 34 receives the second four color image printed by plate cylinders 14, 15, 16, 17 from common blanket cylinder 18 then prints the second four color image on web 12.

Plate cylinders 14, 15, 16, 17, common blanket cylinder 18, and circumferential sections 31, 32, 33, 34 are appropriately configured and phased so that circumferential sections 31, 32 print first four color images on web 12 printed by the respective first plates of plate cylinders 14, 15, 16, 17 on common blanket cylinder 18 and circumferential sections 33, 34 print second four color images on web 12 printed by the respective second plates of plate cylinders 14, 15, 16, 17 on common blanket cylinder 18. Circumferential sections 31, 32, 33, 34 are also appropriately configured and phased so that circumferential sections 31, 32 print every other four color image on web 12, while circumferential sections 33, 34 print intervening four color images. In a preferred embodiment, there should not be any unprinted space between the first four color images printed by circumferential sections 31, 32 and adjacent second four color images printed by circumferential sections 33, 34.

Print unit 20 includes plate cylinders 24, 25, 26, 27 and transfer bodies 145, 146. Transfer bodies 145, 146 may include support cylinders 45, 46 and circumferential sections 41, 42, 43, 44 similar to support cylinders 35, 36 and circumferential sections 31, 32, 33, 34 of transfer bodies 135, 136, respectively. Two plates are disposed about the surface of each plate cylinder 24, 25, 26, 27. Each plate cylinder 24, 25, 26, 27 is inked with a different color ink and rotates counterclockwise about a respective axis during operation. Plate cylinders 24, 25, 26, 27 may print four color images on common blanket cylinder 28, which are transferred to circumferential sections 41, 42, 43, 44, with print unit 20 printing in a manner similar to how print unit 10 prints.

Surfaces of circumferential sections 31, 32, 33, 34, 41, 42, 43, 44 are raised above surfaces of support cylinders 35, 36, 45, 46 so that each circumferential section 31, 32, 33, 34, 41, 42, 43, 44 contacts respective common blanket cylinder 18, 28 and web 12 during a single revolution about the axis of transfer bodies 135, 136, 145, 146, respectively. Surfaces of support cylinders 35, 36, 45, 46, which can be defined as not raised, do not come into contact with web 12 or respective common blanket cylinders 18, 28. This configuration allows circumferential sections 31, 32, 33, 34, 41, 42, 43, 44 to accelerate or decelerate while not in contact with web 12 or respective common blanket cylinders 18, 28 without smearing the respective four color images on common blanket cylinders 18, 28 and web 12. In a preferred embodiment, circumferential sections 31, 32, 33, 34, 41, 42, 43, 44 are driven independently of one another, allowing each circumferential section 31, 32, 33, 34, 41, 42, 43, 44 to independently accelerate and decelerate. For example, circumferential section 31 may be driven independently of circumferential section 32, and therefore circumferential section 32 can be accelerated while circumferential section 31 is printing an image on web 12 without causing the image being printed by circumferential section 31 to be smeared.

Circumferential sections 31, 32, 33, 34, 41, 42, 43, 44 may need to accelerate, decelerate, or simply travel at constant velocities depending on the positioning of the transfer bodies 135, 136, 145, 146 in relation to the respective common blanket cylinders 18, 28, the velocity of web 12 in relation to the velocity of respective common blanket cylinders 18, 28, and the length of the images on the respective first and second plates of plate cylinders 14, 15, 16, 17, 24, 25, 26, 27.

Surfaces of circumferential sections 31, 32, 33, 34, 41, 42, 43, 44 run at substantially the same velocity as respective common blanket cylinders 18, 28 as circumferential sections 31, 32, 33, 34, 41, 42, 43, 44 contact respective common blanket cylinders 18, 28 and run at substantially the same velocity as web 12 as circumferential sections 31, 32, 33, 34, 41, 42, 43, 44 contact web 12. Thus, when web 12 travels at a different rate than the surface of common blanket cylinders 18, 28, circumferential sections 31, 32, 33, 34, 41, 42, 43, 44 have to accelerate and decelerate when rotating between web 12 and respective common blanket cylinders 18, 28, and when rotating between respective common blanket cylinders 18, 28 and web 12.

In alternative embodiments, plate cylinders 14, 15, 16, 17 each may include one printing plate including one or more images or printing plates may not be required, with one or more images directly imaged on plate cylinders 14, 15, 16, 17. In these embodiments, respective circumferential sections 31, 32, 41, 42 may receive a first portion of images from respective common blanket cylinder 18, 28 and print the first portion of the images on web 12 and respective circumferential sections 33, 34, 43, 44 will receive second portions of the images from common blanket cylinder 18, 28 and print the second portion of the image on web 12.

Figure 2A:
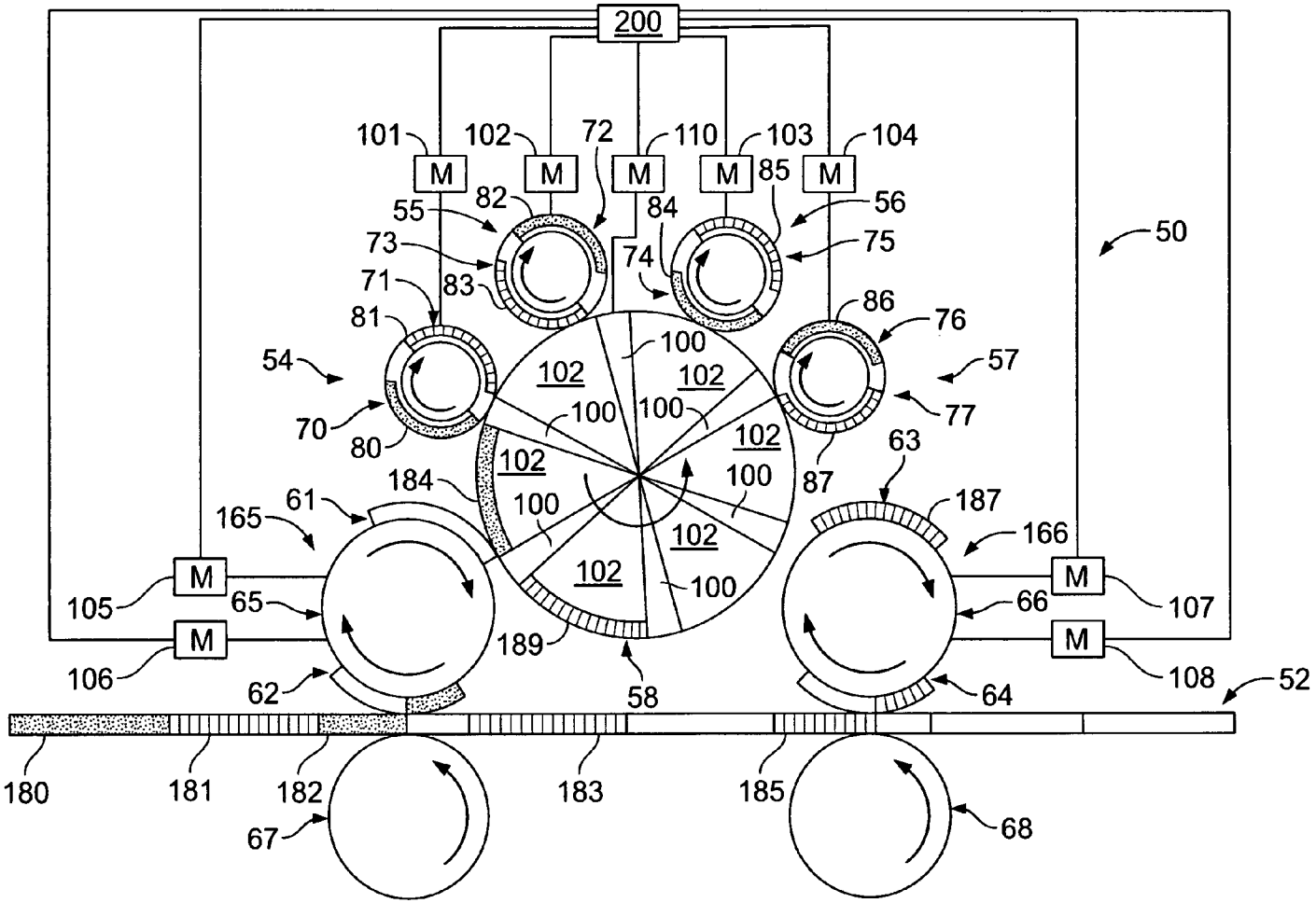
FIG. 2*a* shows a schematic side view of a nonperfecting printing press according to an embodiment of the present invention.
Figure 2B:
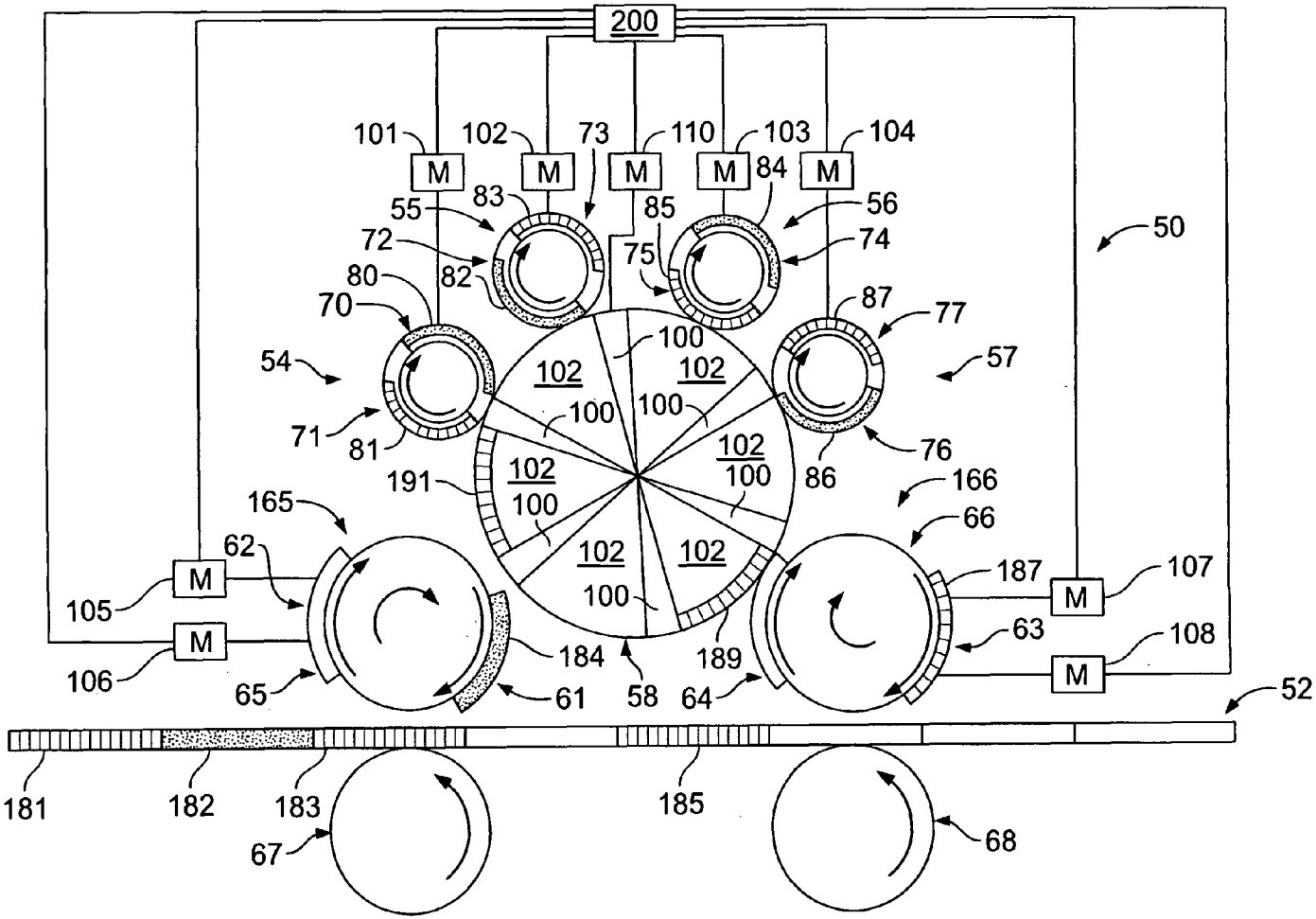
FIG. 2*b* shows a schematic side view of the nonperfecting printing press shown in FIG. 2*a;*
Figure 2C:
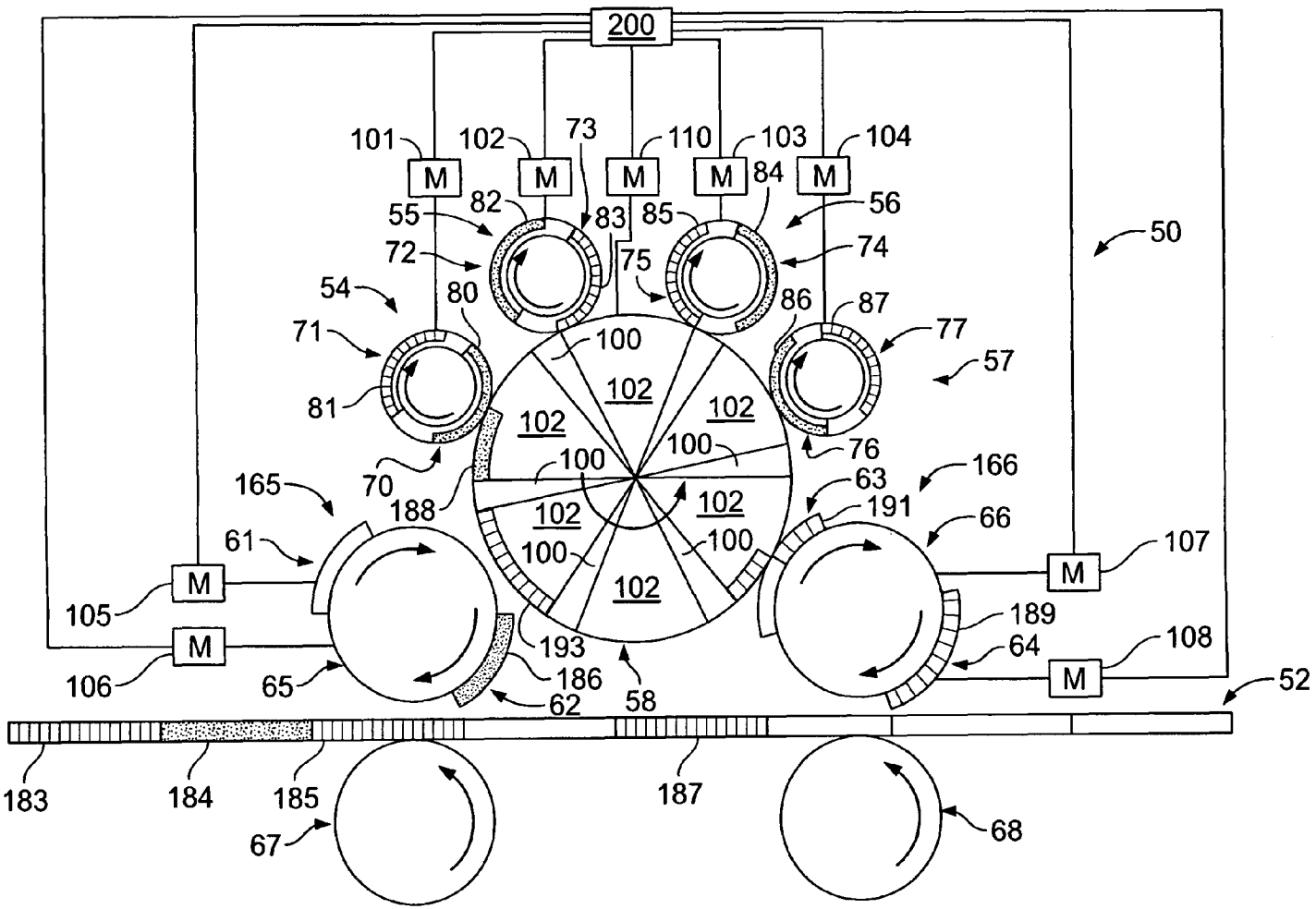
FIG. 2*c* shows a schematic side view of the nonperfecting printing press shown in FIGS. 2*a* and 2*b*.

FIGS. 2*a* to 2*c* show schematic side views of a nonperfecting printing press 50 according to an embodiment of the present invention printing on web 52. FIGS. 2*a* to 2*c* show an example of how, according to an embodiment of the present invention, plate cylinders 54, 55, 56, 57 print four color images on common blanket cylinder 58, which are transferred to circumferential sections 61, 62, 63, 64 and printed on web 52, in a manner similar to how printing units 10, 20 print.

Each plate cylinder 54, 55, 56, 57 is driven by a respective motor 101, 102, 103, 104. In an alternative embodiment, one or more plate cylinders 54, 55, 56, 57 can be driven by a common motor. Each plate cylinder 54, 55, 56, 57 includes a first plate 70, 72, 74, 76, respectively, and a second plate 71, 73, 75, 77, respectively. Each plate cylinder 54, 55, 56, 57 is inked with a different colored ink and rotates clockwise about a respective axis during operation. Plate cylinders 54, 55, 56, 57, during printing mode, are in constant contact, via respective plates 70, 71, 72, 73, 74, 75, 76, 77 with a common blanket cylinder 58, which is rotated counterclockwise about an axis by a motor 110. In an alternative embodiment, a common motor can rotate plate cylinders 54, 55, 56, 57 and common blanket cylinder 58. Surfaces of plates 70, 71, 72, 73, 74, 75, 76, 77 and the surface of common blanket cylinder 58 may travel at substantially equal velocities.

Plates 70, 71, 72, 73, 74, 75, 76, 77 of plate cylinders 54, 55, 56, 57 carry formed images 80, 81, 82, 83, 84, 85, 86, 87. Each plate cylinder 54, 55, 56, 57 is provided with a different colored ink. First inked images, corresponding to respective formed images 80, 82, 84, 86, are printed on common blanket cylinder 58 by first plates 70, 72, 74, 76 on plate cylinders 54, 55, 56, 57, respectively. Second inked images, corresponding to respective formed images 81, 83, 85, 87, are printed on common blanket cylinder 58 by second plates 71, 73, 75, 77 on plate cylinders 54, 55, 56, 57, respectively. First inked images are printed on top of one another on common blanket cylinder 58 to form first four color images 180, 182, 184, 186, 188, which are shown schematically in FIGS. 2*a* to 2*c* by solid black. Second inked images printed by second plates 71, 73, 75, 77 are printed on top of one another on common blanket cylinder 58 to form first four color images 181, 183, 185, 187, 189, 191, 193, which are shown schematically in FIGS. 2*a* to 2*c* by stripes.

First four color images 180, 182, 184, 186, 188 are transferred from common blanket cylinder 58 to circumferential sections 61, 62, respectively, which print first four color images 180, 182, 184, 186, 188 on passing web 52. Second four color images 181, 183, 185, 187, 189, 191, 193 are transferred from common blanket cylinder 58 to circumferential sections 63, 64, respectively, which print second four color images on passing web 52. Circumferential sections 61, 62, 63, 64 may be rotated about respective support cylinders 65, 66 by motors 105, 106, 107, 108, respectively. Formed images 80, 81, 82, 83, 84, 85, 86, 87 on plates 70, 71, 72, 73, 74, 75, 76, 77, respectively, need to be reverse images so that the double transfer of images, first through common blanket cylinder 58, then through the respective circumferential sections 61, 62, 63, 64, will be right-reading.

Motors 101, 102, 103, 104, 105, 106, 107, 108, 110 may be controlled by a controller 200. Controller 200 ensures cylinders 54, 55, 56, 57, 58, and circumferential sections 61, 62, 63, 64 are properly phased and positioned so four color images are printed on web 52 in a proper alignment. A first impression cylinder 67 and a second impression cylinder 68 may provide counter-pressure for circumferential sections 61, 62, 63, 64 of support cylinders 65, 66, respectively, while circumferential sections 61, 62, 63, 64 are printing on web 52.

As shown in the embodiment in FIGS. 2*a* to 2*c*, images 80, 81, 82, 83, 84, 85, 86, 87 on plates 70, 71, 72, 73, 74, 75, 76, 77, respectively, do not take up the entire length of respective plates 70, 71, 72, 73, 74, 75, 76, 77. In this embodiment, plates 70, 71, 72, 73, 74, 75, 76, 77 are all of equal length. Images 80, 81, 82, 83, 84, 85, 86, 87 also are all of equal length. Thus, plates 70, 71, 72, 73, 74, 75, 76, 77 have portions that are prepared as non-print area. Web 52 travels a distance substantially equal to the length of one of images 80, 81, 82, 83, 84, 85, 86, 87 in a time each plate cylinder 54, 55, 56, 57 performs one half of a revolution. Therefore, printing surfaces of plates 70, 71, 72, 73, 74, 75, 76, 77 may travel at a greater velocity than web 52. For example, if each plate cylinder 54, 55, 56, 57, including corresponding plates 70, 71, 72, 73, 74, 75, 76, 77 has a permanent circumference of 50 inches, and plates 70, 71, 72, 73, 74, 75, 76, 77 are each 25 inches long but each printing an image that is only 21 inches long, then web 17 may travel 16% [(50−(2)*(21))/50=8/50=0.16] more slowly than the printing surfaces of plate cylinders 54, 55, 56, 57.

When plates 70, 71, 72, 73, 74, 75, 76, 77 have portions of non-print area, there will be corresponding non-printed spaces between first four color images and second four color images printed on common blanket cylinder 58 by plates 70, 71, 72, 73, 74, 75, 76, 77. If a length of a circumference of common blanket 58 is equal to an integer multiple of the length of the circumference of each plate cylinder 54, 55, 56, 57, then the non-printed spaces on common blanket cylinder 58 will not vary with each revolution of blanket cylinder 58. In the schematic embodiment shown in FIGS. 2*a* to 2*c*, the length of the circumference of common blanket cylinder 58 is assumed to be substantially equal to three times the surface of each plate cylinder 54, 55, 56, 57. Accordingly, common blanket cylinder 58 is schematically shown divided into six equal sections for illustrative purposes. Each section includes an image transferring portion 102, which has a surface length equal to the length of each formed image 80, 81, 82, 83, 84, 85, 86, 87, and a non-printed space 100, which has a surface length equal to the portions of non-print area on each plate 70, 71, 72, 73, 74, 75, 76, 77. Image transferring portion 102 and non-printed space 100 demonstrate where inked images of formed images 80, 81, 82, 83, 84, 85, 86, 87 may be printed on common blanket cylinder 58 and where portions of non-print area of plates 70, 71, 72, 73, 74, 75, 76, 77 may contact the surface of common blanket cylinder 58.

In a preferred embodiment each first four color image forms one continuous image with an adjacent second four color image. A cutoff length of each continuous image equals a length of each first four color image plus the length of each second four color image. To vary the cutoff of the continuous images printed by printing press 50 the plates 70, 71, 72, 73, 74, 75, 76, 77 could be replaced with respective replacement plates having images that vary in length from images 80, 81, 82, 83, 84, 85, 86, 87.

Figure 3:
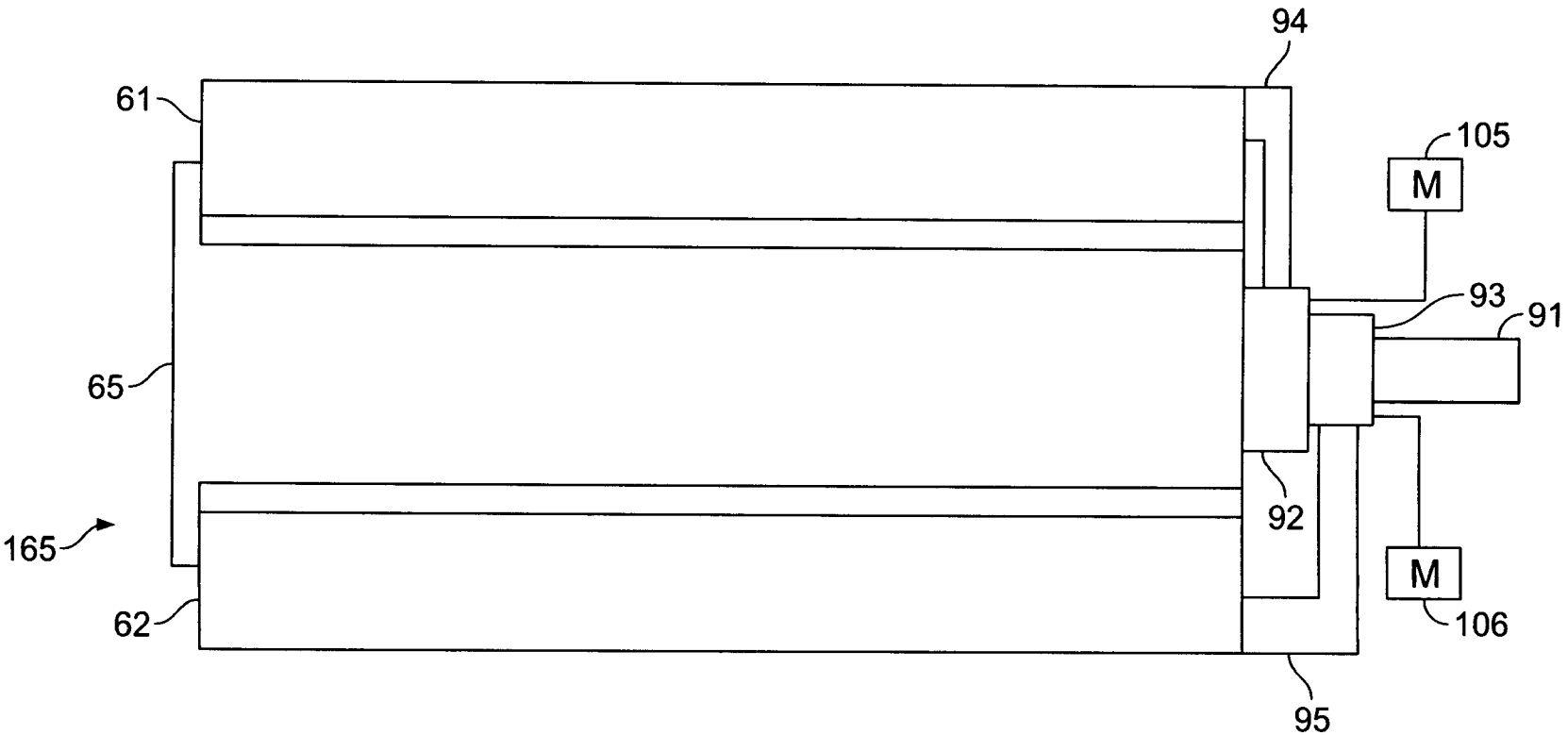
FIG. 3 shows a schematic front view of a transfer body shown in FIGS. 2*a* to 2*c*.

FIG. 3 shows a schematic front view of an embodiment of transfer body 165 shown in FIGS. 2*a* to 2*c*. Transfer body 165 has a support shaft 91, which can attach to a frame or other supporting device to stabilize support cylinder 65 and circumferential sections 61, 62. In this embodiment, circumferential sections 61, 62 independently rotate about support cylinder 65. Circumferential sections 61, 62 are attached to support arms 94, 95, respectively. Support arms 94, 95 are attached to respective bearings 92, 93 that are rotatably attached to support shaft 91. Bearings 92, 93 are rotated by respective motors

105, 106 about support shaft 91, thereby driving circumferential sections 61, 62, respectively, about support cylinder 65. Transfer body 166 (FIGS. 2*a* to 2*c*) and transfer bodies 135, 136, 145, 146 (FIG. 1) may be similarly configured.

In alternative embodiments circumferential sections 31, 32, 33, 34, 41, 42, 43, 44, 61, 62, 63, 64 may, respectively, be circumferential sections on common axes with no respective support cylinders 35, 36, 45, 46, 65, 66. For example, support cylinder 65 would be absent, with circumferential sections 61 and 62 independently rotating about a common axis to receive four color images from common blanket cylinder 58 and print those images on web 52.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method of variable cutoff web printing comprising the steps of:

transferring a first first image and a second first image to a common blanket cylinder;

transferring the first first image from the common blanket cylinder to a first circumferential section movable with respect to a second circumferential section having a same rotational axis as the first circumferential section;

printing the first first image on a web using the first circumferential section;

transferring the second first image from the common blanket cylinder to the second circumferential section; and printing the second first image on the web using the second circumferential section.

2. The method of printing as recited in claim 1 wherein the first and the second first images are four color images.

3. The method of printing as recited in claim 1 further comprising rotating the first circumferential section at a varying velocity after the first first image is printed on the web using the first circumferential section.

4. The method of printing as recited in claim 1 further comprising:

transferring a first second image and a second second image to the common blanket cylinder;

transferring the first second image from the common blanket cylinder to third circumferential section movable with respect to a fourth circumferential section having a same rotational axis as the third circumferential section;

printing the first second image on the web between the first and the second first images using the third circumferential section;

transferring the second second image from the common blanket cylinder to the fourth circumferential section; and printing the second second image on the web following the second first image using the fourth circumferential section.

* * * * *